US009093808B2

(12) United States Patent
Holzapfel et al.

(10) Patent No.: US 9,093,808 B2
(45) Date of Patent: Jul. 28, 2015

(54) VIBRATION-RESISTANT SLIP RING DEVICE

(71) Applicant: Schleifring und Apparatebau GmbH, Fürstenfeldbruck (DE)

(72) Inventors: Christian Holzapfel, Fürstenfeldbruck (DE); Peter Heinbuch, München (DE); Johannes Ott, Fürstenfeldbruck (DE)

(73) Assignee: SCHLEIFRING UND APPARATEBAU GMBH, Furstenfeldbruck (DE)

( * ) Notice: Subject to any disclaimer, the term of this patent is extended or adjusted under 35 U.S.C. 154(b) by 40 days.

(21) Appl. No.: 14/046,317

(22) Filed: Oct. 4, 2013

(65) Prior Publication Data

US 2014/0038432 A1 Feb. 6, 2014

Related U.S. Application Data

(63) Continuation of application No. PCT/EP2012/056099, filed on Apr. 3, 2012.

(51) Int. Cl.

| | |
|---|---|
| ***H01R 39/24*** | (2006.01) |
| ***H01R 39/64*** | (2006.01) |
| ***H01R 39/08*** | (2006.01) |
| ***H01R 39/18*** | (2006.01) |

(52) U.S. Cl.
CPC ..... *H01R 39/64* (2013.01); *H01R 39/08* (2013.01); *H01R 39/18* (2013.01)

(58) Field of Classification Search
CPC ..... H01R 39/64; H01R 35/04; H01R 39/00; H01R 39/26; H01R 39/24; H01R 39/08; H01R 39/34
USPC ..... 439/13, 18, 22–26, 20; 310/248, 232
See application file for complete search history.

(56) References Cited

U.S. PATENT DOCUMENTS

| | | | | |
|---|---|---|---|---|
| 3,329,923 | A | 7/1967 | Davis | 439/28 |
| 4,098,526 | A * | 7/1978 | DuBois | 285/119 |
| 4,323,292 | A * | 4/1982 | Lewis et al. | 439/28 |
| 4,398,113 | A | 8/1983 | Lewis et al. | 310/232 |
| 4,447,752 | A * | 5/1984 | Boyce et al. | 310/232 |
| 4,544,215 | A * | 10/1985 | Fritsch | 439/13 |
| 5,124,606 | A | 6/1992 | Eisenbeis | 310/114 |
| 5,124,608 | A | 6/1992 | Lawrence et al. | 310/232 |
| 5,865,629 | A | 2/1999 | Bernardini | 439/26 |

(Continued)

FOREIGN PATENT DOCUMENTS

| | | |
|---|---|---|
| DE | 201 15 215 | 11/2001 |
| DE | 201 21 366 | 8/2002 |

(Continued)

*Primary Examiner* — Gary Paumen
(74) *Attorney, Agent, or Firm* — Norton Rose Fulbright US LLP

(57) ABSTRACT

A slip ring device for the electrical connection of two mutually rotatable parts includes one or more slideways each with at least one V-groove. At least two wire brushes are provided which run in (are configured to extend into) the V-grooves. The wire brushes are electrically connected to each other and are mounted on at least two different brush blocks which are mechanically decoupled from one another. Increased insensitivity to vibrations and mechanical impacts can be achieved in this way.

11 Claims, 3 Drawing Sheets

(56) References Cited

U.S. PATENT DOCUMENTS

| | | | | |
|---|---|---|---|---|
| 6,356,002 | B1 * | 3/2002 | Witherspoon et al. | 310/232 |
| 6,517,357 | B1 * | 2/2003 | Athanasiou et al. | 439/26 |
| 7,001,184 | B2 * | 2/2006 | Abouchar | 439/26 |
| 7,774,935 | B2 | 8/2010 | Barbet et al. | 29/878 |
| 8,167,623 | B2 * | 5/2012 | Schlichtherle et al. | 439/26 |
| 2005/0230098 | A1 * | 10/2005 | Sand et al. | 166/65.1 |
| 2007/0167032 | A1 * | 7/2007 | Angerpointner et al. | 439/22 |
| 2014/0045348 | A1 * | 2/2014 | Lewis et al. | 439/18 |

FOREIGN PATENT DOCUMENTS

| | | |
|---|---|---|
| DE | 203 12 458 | 12/2004 |
| DE | 20 2006 009 981 | 8/2006 |
| DE | 10 2008 001361 | 1/2011 |
| EP | 0 662 736 | 7/1995 |
| EP | 2 019 460 | 1/2009 |
| JP | 2006 164 900 | 6/2006 |
| WO | WO/2009/130277 | 10/2009 |

* cited by examiner

VIBRATION-RESISTANT SLIP RING DEVICE

PRIORITY CLAIM

This application is a continuation of pending International Application No. PCT/EP2012/056099 filed on 3 Apr. 2012, which designates the United States and claims priority from German Application No. 102011006820.1 filed on 6 Apr. 2011.

BACKGROUND OF THE INVENTION

1. Field of the Invention

The invention relates to a slip ring device for transmitting electrical signals by means of sliding contacts between mutually rotatable parts. At least one sliding contact which is made of an electrically conductive material and is also known as the brush slides on a slideway which is also made of an electrically conductive material. Electric current is transmitted by galvanic contact between the slideways and the contact.

2. Description of Relevant Art

A slip ring device in which a brush runs with at least two slide wires in a slideway with a V-groove is disclosed in DE 10 2008 001 361 A1. The slide wires have different diameters and touch the slideway at different angular positions. This leads to increased tolerance over mechanical vibrations and impacts and to reduced contact resistance.

EP 0662736 A discloses a slip ring device in which an individual brush includes several wires which run in a V-groove. This leads to a low contact resistance by switching several contacts in parallel.

U.S. Pat. No. 4,398,113 A discloses a further slip ring device with brushes which include a plurality of ultrafine wires. A relatively low contact resistant is obtained in this case too as a result of the multiple contacts.

U.S. Pat. No. 5,124,606 discloses a low noise slipring assembly, where a pair of brushes running at a sliding track is held by a single brush holder. The brushes are arranged and opposing sides of the sliding track.

It is disadvantageous in the state of the art that none of these slip ring devices allow reliable electrical contact at high shock and impact loads. Brief contact interruptions occur from the lifting of the brushes from the slideway in the event of brief strong impacts or vibrations. Similarly, interruptions can also occur by vibrations which are produced at different rotational speeds.

SUMMARY OF THE INVENTION

The embodiments are based on the object of providing a slip ring device in such a way that it ensures reliable electrical contact even in the case of strong brief impacts or vibrations. At the same time, this slip ring device is to be manufactured in a simple way and at low cost and shall offer a long operational lifespan and high reliability.

In an embodiment, a slip ring device includes a slideway and at least two mechanically separated brush blocks (also known as brush gear units) with brushes. For at least one signal path, i.e. a simple electrical connection between the mutually rotatable parts, at least one respective wire brush on at least two separate brush blocks are electrically connected to each other. For a signal path on two separate brush blocks, one brush each can be connected to each other for example. Similarly, a different number of brushes per brush block can also be connected to each other. For example, one brush on a brush block can be connected to two brushes on another brush block. Furthermore, several brush blocks can be combined with one another. Consequently, one brush each on three different brush blocks can be connected to each other.

The brushes are metal wires and include at least one electrically conductive material. Preferably, they have a core made of a mechanically stable and resilient material such as steel or brass, and an outer coating or sleeve made of an electrically well-conducting and preferably corrosion-resistant material such as gold or a gold alloy. Preferably, the brush blocks are printed circuit boards.

The slideway preferably includes at least one V-groove for guiding the brushes. Slideways with other geometries can principally be used. They can be flat slideways or slideways with U-shaped grooves (semi-spherical, elliptical).

The brushes can also run on different slideways, which include different track diameters and therefore different speeds, different surface structures and/or coatings.

Extensive examinations have shown that no sufficient resistance to impacts and vibrations or the suppression of oscillations can be achieved with a slip ring device with only one single brush block. This is also caused among other things by the limited mechanical stiffness of a printed circuit board as is mostly used for fixing the brush wires or any other supporting body or material. Even if different wire diameters with different wire lengths or also contact points of the wires on the slideway are used, as disclosed in the state of the art, mechanical linkages will always be obtained by the common printed circuit board or the common brush block. Substantially improved resistance to impacts and vibrations can only be achieved by a strict mechanical decoupling of the slip ring brushes from one another.

Preferably, wire brushes with different wire geometries, especially different wire diameters, are present on the brush blocks. Wires of different geometries can have different cross sections, e.g. round, elliptical or even rectangular or square. The wires can also have different surfaces and/or different coatings. They could be made of different materials, which have different vibration properties due to different density and/or different mechanical damping for example.

It is further preferred, when a respectively different number of wire brushes are provided on the brush blocks.

It is further preferred, when the wire brushes of the different brush blocks run on different tracks, especially preferably in different V-grooves.

It is preferred, when at least two brush blocks are arranged opposite of one another with reference to the rotational axis.

It is preferred, when at least one brush block is mounted in a vibration-dampened way. Preferably, the brush blocks are mounted in different vibration-dampened ways. As a result, they will preferably have different damping values and/or different resonant frequencies.

Preferably, at least two brush blocks have different shapes. As a result, the vibration properties of these brush blocks will also be different.

Several brush blocks which are electrically connected to each other are advantageously arranged in a distributed manner at equal distances around the slideway. As a result, three brush blocks can respectively be arranged offset by 120° or even four brush blocks respectively offset by 90°. The resistance to impacts and vibrations can be increased in this way even further.

Alternatively, several brush blocks which are electrically connected to each other are arranged in a distributed manner at different distances around the slideway. As a result, three brush blocks can be arranged offset by 90°, 120° and 150°. The resistance to impacts and vibrations can further be increased in this way too.

In a further advantageous embodiment, at least one wire brush includes at least a partial encasing in order to change the vibration properties. This encasing can consist of an elastic material for example. It is preferably arranged outside of the region that is in contact with the slideway. It is especially preferred that different wire brushes on different brush blocks have different types of encasings. It is especially advantageous when a first slide wire on a first brush block has an encasing, whereas a second slide wire on a second brush block has no encasing.

In another embodiment, the ends of the slide wires protrude substantially beyond the contact point with the slideway. The protruding length lies in a range of between 0.2-2 times the length between the brush block and the contact point with the slideway. The protruding end will be bent away from the slip ring in an especially preferred manner.

BRIEF DESCRIPTION OF THE DRAWINGS

In the following, the invention will be described by way of example, without limitation of the general inventive concept, on examples of embodiment and with reference to the drawings.

Figure 1:
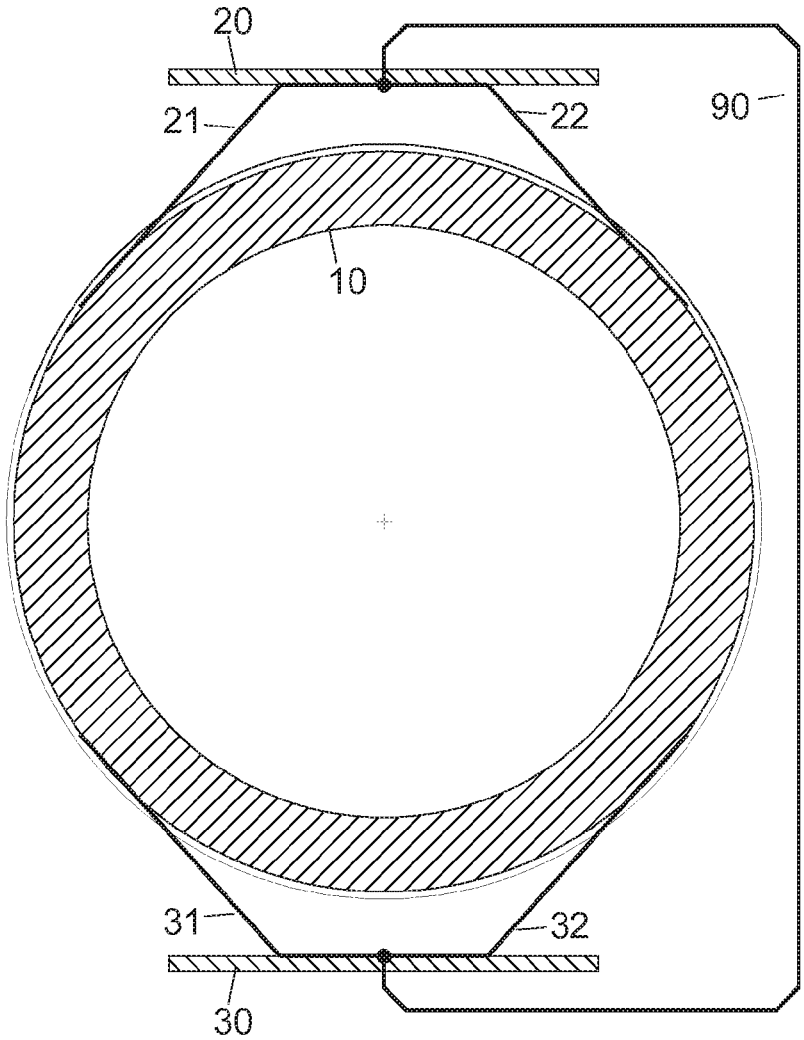
FIG. 1 shows a first embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a first embodiment. The slip ring device includes a slip ring body 10 with a slideway (also called sliding track) and a first brush block 20 and a second brush block 30. The first brush block 20 includes a first wire brush with a first leg 21 and a second leg 22. The second brush block 30 includes a second wire brush with a first leg 31 and the second leg 32. In both wire brushes the two legs are respectively connected to each other in a electrically conductive manner. The drawing shows two legs with wire brushes by way of example, because they are used especially frequently. The embodiment can be realized similarly with wire brushes with only one leg 21 or 22. Combinations thereof would also be possible. As a result, the first wire brush could include only one leg 21 for example, whereas the second wire brush includes two legs 31, 32. Finally, the first brush and the second brush are connected to each other in an electrically conductive way via an electrical connection 90. The embodiment as illustrated here with two brush blocks arranged opposite of one another is especially advantageous. If for example the slip ring body 10 is moved downwardly by an impact, the first wire brush loses the contact with its legs 21 and 22 because the slip ring body will move away from the wire brush. As a result of the same movement however, it will move towards the downwardly situated second wire brush with its legs 31 and 32. The contact will be maintained, but only the pressing pressure will increase in this case.

Figure 2:
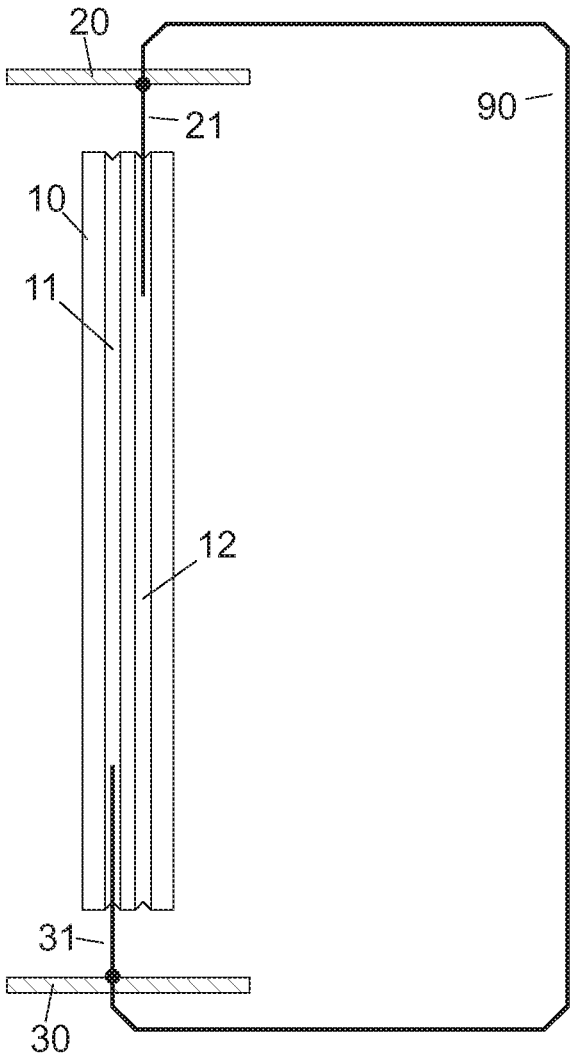
FIG. 2 shows a first embodiment in a side view.

FIG. 2 shows a first embodiment in a side view. A first slideway 11 and a second slideway 12 are disposed on the slip ring body 10. The first wire brush, in which the drawing only shows the first leg 21, runs in the second slideway 12. The second wire brush, in which the drawing only shows the first leg 31, runs in the first slideway 11. Both slideways (not shown) are electrically connected to each other. It is also possible to use more than two slideways for a respective number of wire brushes, wherein in this case all tracks are electrically connected to each other. Principally, the first wire brush and the second wire brush could also run in the same slideway. Although the division among two slideways requires more space and causes higher costs, it consequently offers higher reliability. Current can still be transmitted in this case even when one of the slideways is mechanically damaged for example.

Figure 3:
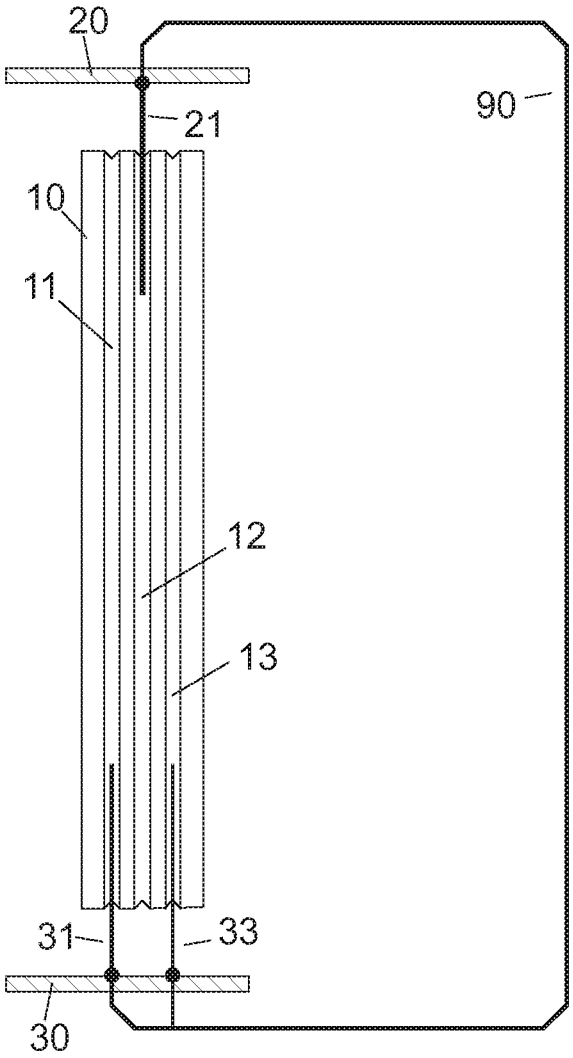
FIG. 3 shows another embodiment with different wire brushes.

FIG. 3 shows another embodiment with different wire brushes. A first wire brush disposed on the first brush block 20, in which the drawing only shows the first leg 21. The wire diameter of this wire brush is larger than the wire diameter of the second and third wire brushes, which are arranged on the second brush block and are represented here by their legs 31 and 32. The second and third wire brushes are electrically connected to the first wire brush by the electrical connection 90. Different resonant frequencies and different damping and increased insensitivity to vibrations are manufactured by the different wire diameters of the wire brushes.

It will be appreciated to those skilled in the art having the benefit of this disclosure that this invention is believed to provide sliprings and sliding contacts for the transmission of electrical signals and/or power. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 Slip ring body
11 First slideway
12 Second slideway
13 Third slideway
20 First brush block
21 First leg of the first wire brush
22 Second leg of the first wire brush
30 Second brush block
31 First leg of the second wire brush
32 Second leg of the second wire brush
33 First leg of the third wire brush
90 Electrical connection

The invention claimed is:

1. A slip ring device for the electrical connection of two mutually rotatable parts, the slip ring device comprising:

a body including one or more slideways each with at least one V-groove; and a plurality of wire brushes each configured to extend into a V-groove of the one or more slideways;

wherein at least two of the wire brushes are electrically connected to each other, are arranged on different brush blocks, and have different wire diameters.

2. A slip ring device according to claim 1, wherein the at least two of the wire brushes are configured to extend into the same V-groove.

3. A slip ring device according to claim 1, wherein at least two brush blocks are arranged opposite of one another with respect to the rotational axis.

4. A slip ring device according to claim 1, wherein at least two brush blocks are mechanically decoupled from one another.

5. A slip ring device according to claim 1, wherein at least one brush block is mechanically mounted in a vibration-dampened way.

6. A slip ring device according to claim 1, wherein at least two brush blocks are mechanically mounted in a vibration-dampened way.

7. A slip ring device according to claim 1, wherein different numbers of the plurality of wire brushes are arranged on different brush blocks.

8. A slip ring device according to claim 1, wherein the body includes two or more slideways, and the at least two of the wire brushes are configured to extend into different ones of the slideways.

9. A slip ring device according to claim 1, wherein the body includes a plurality of V-grooves and the at least two of the wire brushes are configured to extend into different ones of the V-grooves.

10. A slip ring device according to claim 1, wherein at least three brush blocks are arranged equiangular intervals of 120° around a rotational axis of the slip ring device.

11. A slip ring device for the electrical connection of two mutually rotatable parts, the slip ring device comprising:

one or more slideways each with at least one V-groove; and a plurality of wire brushes each configured to extend into a V-groove of the one or more slideways;

wherein at least two of the wire brushes are electrically connected to each other, are arranged on different brush blocks, and have different wire geometries.

* * * * *